US005839884A

United States Patent [19]

Beylich

[11] Patent Number: 5,839,884

[45] Date of Patent: Nov. 24, 1998

[54] SUPERSONIC JET PUMP DEVICE WITH TWO DRIVE NOZZLES

[75] Inventor: Alfred E. Beylich, Aachen, Germany

[73] Assignee: Mannesmann AG, Düsseldorf, Germany

[21] Appl. No.: 776,988

[22] PCT Filed: Aug. 18, 1995

[86] PCT No.: PCT/DE95/01160

§ 371 Date: Mar. 18, 1997

§ 102(e) Date: Mar. 18, 1997

[87] PCT Pub. No.: WO96/06285

PCT Pub. Date: Feb. 29, 1996

[30] Foreign Application Priority Data

Aug. 18, 1994 [DE] Germany ..... 44 30 574.5

[51] Int. Cl.[6] ..... F04F 5/44

[52] U.S. Cl. ..... 417/196; 417/163; 417/170; 417/198

[58] Field of Search ..... 417/163, 170, 417/196, 198

[56] References Cited

U.S. PATENT DOCUMENTS

| | | | |
|---|---|---|---|
| 2,424,722 | 7/1947 | Strohecker et al. | 417/196 |
| 2,602,398 | 7/1952 | Nittka | 417/196 |
| 3,371,618 | 3/1968 | Chambers | 417/196 |
| 4,487,553 | 12/1984 | Nagata | 417/163 |

FOREIGN PATENT DOCUMENTS

| | | | |
|---|---|---|---|
| 313020 | 6/1915 | Germany | 417/163 |
| 1081182 | 2/1959 | Germany | 417/163 |

*Primary Examiner*—Timothy Thorpe
*Assistant Examiner*—Cheryl J. Tyler
*Attorney, Agent, or Firm*—Cohen, Pontani, Lieberman & Pavane

[57] ABSTRACT

A supersonic device including an elongated mixer-diffuser housing having first and second drive nozzles arranged axially and tandemly therein. The first and second drives nozzles are arranged in first and second cylinder parts, respectively, of the mixer-diffuser housing. A conical first mixer part is disposed between the first and second cylinder parts and defines a first mixing zone therein. The second drive nozzle further comprises a generally conical displacement body, preferably configured as a supersonic cone or wedge, which extends into the conical first mixer part.

14 Claims, 3 Drawing Sheets

FIG. 2
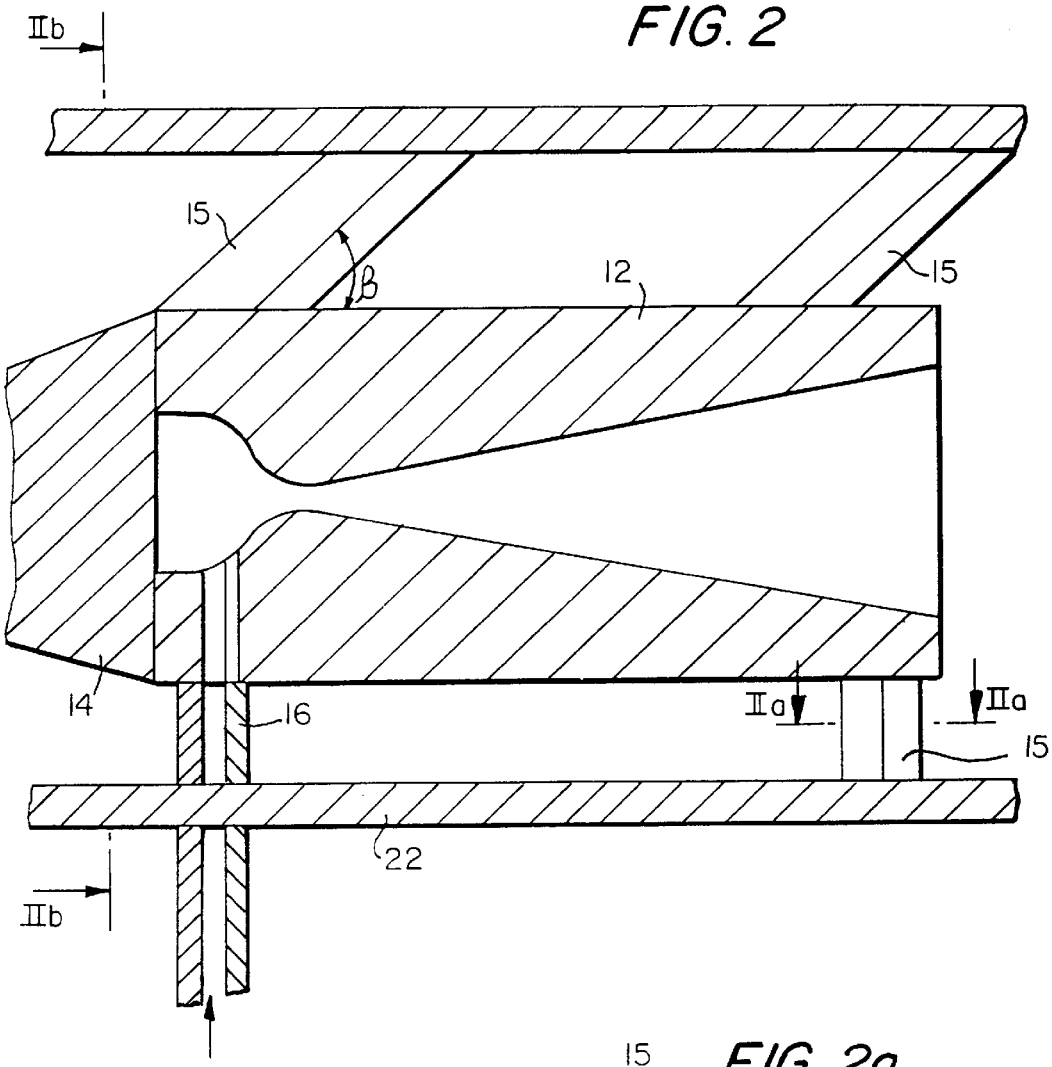
FIG. 2a
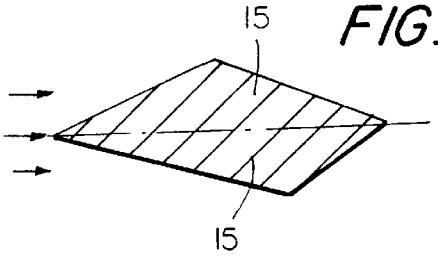
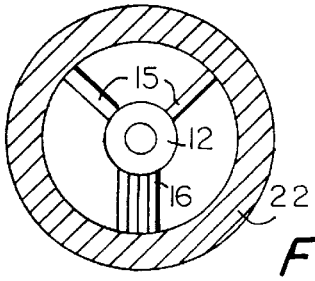
FIG. 2b

SUPERSONIC JET PUMP DEVICE WITH TWO DRIVE NOZZLES

BACKGROUND OF THE INVENTION

1. Field of the Invention

The present invention relates to a supersonic device, and more particularly, to a jet nozzle, having an elongated tubular mixer-diffuser housing having a first drive nozzle disposed axially and in tandem, with a second drive nozzle having a displacement body.

2. Description of the Prior Art

Multiple ejectors which includes at least two nozzles arranged by decreasing size one behind the other in the direction of flow can be used for various purposes. Thus, from German Patent No. 3025525 A1, an ejector device is known in which at least two ejectors formed of a corresponding number of jet nozzles of increasing size are arranged axially one behind the other within a common elongated housing. The common housing consists of a plurality of sections which adjoin each other in longitudinal direction and can be combined in any desired manner with each other, each of the sections containing at most one transverse wall. The ejector device disclosed in this reference is used, for instance, to produce pressure and vacuum for mechanically moving sheets of paper in printing plants, and therefore only produce a very slight vacuum, i.e. very small pressure ratios and very small quantities of fluid flow. The conversion of pressure into kinetic energy which takes place in the nozzles of these ejector devices is only slight and is not comparable to high-performance supersonic nozzles which can produce high pressure ratios.

A conventional supersonic device having two drive nozzles is known from the dissertation of H. R. Loser of the Polytechnical Institute of Darmstadt, dated Nov. 8, 1965. The supersonic device disclosed in this reference has the structural shape of a conventional two-stage supersonic ejector which is formed of two individual stages with central primary nozzles and cylindrical mixing chambers. Adjoining the mixing chamber of the second stage is the conventional subsonic cone diffuser.

As a result of this dissertation, it is known that small secondary pressure ratios are possible only in conjunction with small mass ratios, and can be improved by increasing the primary pressure. The two-stage ejector disclosed in this reference can thus be used only for small mass ratios.

In addition, the two-stage supersonic ejector is characterized by a disadvantageous power-losing deceleration in the first supersonic diffuser, followed by acceleration in the adjoining part.

SUMMARY OF THE INVENTION

It is accordingly an object of the present invention to provide a structurally simple supersonic device which produces a propellant related increase in power.

The jet nozzle of the present invention comprises first and second drive nozzles arranged axially and in tandem in respective first and second cylindrical parts of a mixer-diffuser housing. In operation, the first and second drive nozzles produce respective first and second jet cores at their respective output openings. The cylindrical parts are connected to each other by a generally conical first mixer part, which defines therein a mixing zone for the first nozzle. The second drive nozzle includes a displacement body which extends into the first mixer part. As a result, the power losses typically associated with tandemly arranged drive nozzles due to degradation of compression pulses emanating from the first drive nozzle are avoided. However, avoiding the degradation of the compression pulses advantageously increases the pressure in the first jet nozzle. Therefore, while high-power jet nozzles typically have a pressure ratio of no more than $\gamma=12$, pressure ratios of between $\gamma=20$ to 30 may now be developed in a tandem jet nozzle under equivalent propellant steam consumption conditions. Furthermore, a tandem jet nozzle designed for a pressure ratio of approximately $\gamma=12$ consumes about half the amount of steam as a conventional jet nozzle. When configured as a two-stage tandem jet nozzle, a total steam savings of approximately 70% is possible.

Therefore, attempts to configure a jet pump according to the prior art for a pressure ratio of $\gamma=20$–30 would lead not only to an uneconomical consumption of steam but could not be obtained at all in actual practice.

The generally conical displacement body disposed on the second drive nozzle is configured as a supersonic cone or wedge, the tip or edge of which extends into the conically tapering first mixing zone defined within the first mixer part to such an extent that it encroaches upon a part of the jet core of the first drive nozzle.

A tandem jet nozzle equipped with a supersonic cone or wedge diffuser disposed on the second drive nozzle, as in the present invention, operates with considerably less loss than conventional jet nozzles configured with mixer parts having impact diffuser tubes. Furthermore, the structural length of the integrated tandem nozzle of the present invention is less than prior art systems, including two-stage systems. In addition, conical parallel-flow mixing chambers, of the type employed by the present invention, are considerably more efficient that the cylindrical mixing chambers typically used on high-performance jet nozzles.

The second drive nozzle is approximately 0.8 times smaller than the first drive nozzle and is disposed in a first transonic region defined in the second cylindrical part. The second cylindrical part extends past the exit or output opening of the second drive nozzle, i.e. the end opposite the displacement body, and defines a second mixing zone therein which is substantially free of obstruction.

A generally conical second mixer part connects to the second cylinder part. An impulse diffuser extends from the second mixer part and defines a second transonic region therein. As a final stage, a generally conical subsonic diffuser extends from the impulse diffuser.

The second drive nozzle is fixedly mounted and supported within the mixer-diffuser housing by at least three struts. One of the struts is preferably configured as a propellant feed strut. The cross-sectional profile of the struts is configured for minimal impedance to fluid flow through the second cylinder part. To further reduce restriction of fluid flow, the struts may be disposed with respect to the second drive nozzle at an angle of less than 70°.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention. An example of the invention is shown in the drawings and described in greater detail below.

DESCRIPTION OF THE DRAWINGS

In the drawings, wherein like reference characters are used to denote similar elements throughout the several views:

FIG. 2 is a partial cross-sectional view of the second drive nozzle of the jet nozzle of FIG. 1;

FIG. 2*a* is a cross-sectional view of a support strut of the present invention taken along the line A—A of FIG. 2;

FIG. 2*b* is a cross-sectional view of the second drive nozzle of the present invention taken along line B—B of FIG. 2.

DESCRIPTION OF THE PRESENTLY PREFERRED EMBODIMENTS

Figure 1:
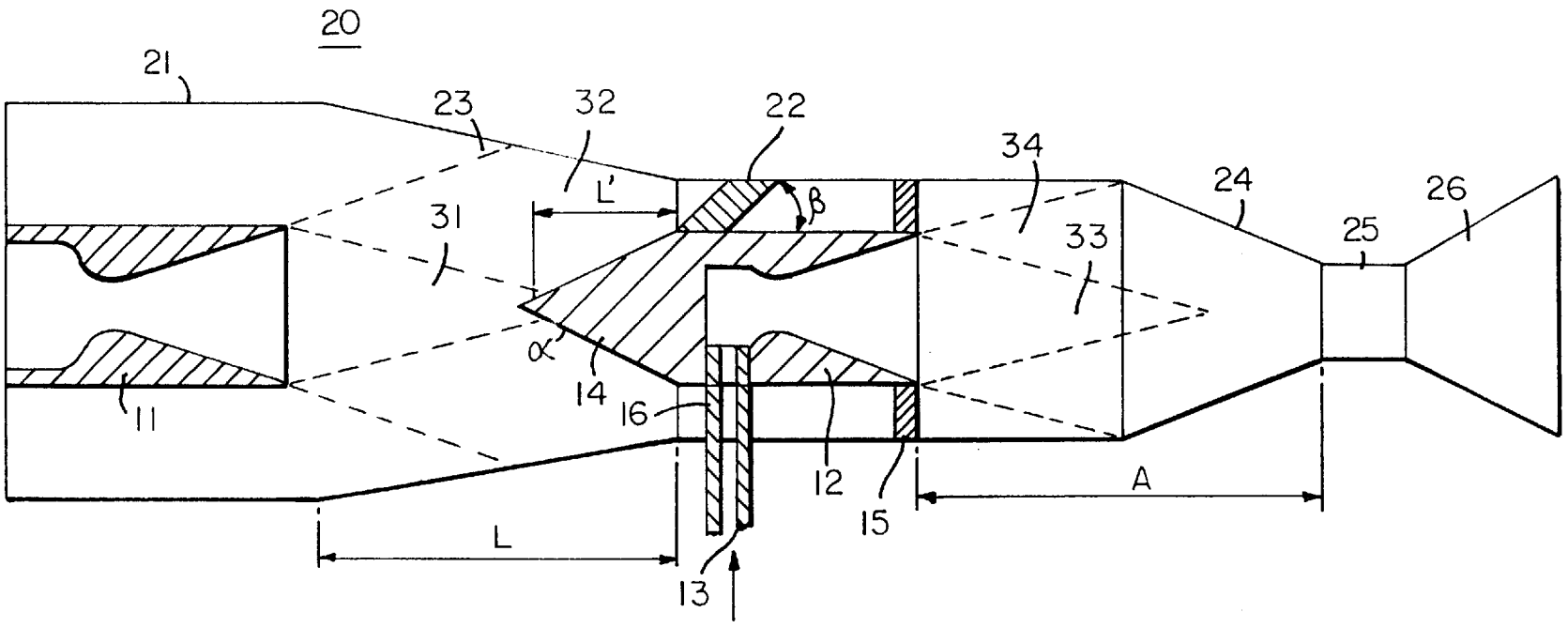
FIG. 1 is a cross-sectional view of a supersonic jet nozzle configured according to the present invention.

Referring now to the drawings, and in particular, to FIG. 1, a supersonic jet nozzle according to the present invention includes an elongated generally tubular mixer-diffuser housing 20 comprising a generally cylindrical first cylinder part 21 which connects to a generally conical first mixer part 23 within which is defined a first mixing zone 32. The first mixer part 23 is defined by a length L. A generally cylindrical second cylinder part 22 is connected on one end to the first mixer part 23 and on an end opposite thereto, defines a second mixing zone 34. A generally conical second mixer part 24 is connected to the second cylinder part 22 adjacent the second mixing zone 34. A generally cylindrical impulse diffuser 25 is connected on one end to the second mixer part 24 and on the other end to a generally conical subsonic diffuser 26.

A first drive nozzle It is arranged in the first cylinder part 21 coaxial and in tandem with a second drive nozzle 12 which is arranged in the second cylinder part 22. A plurality of struts 15 secure and support the second drive nozzle 12 within the second cylindrical part 22. In a preferred embodiment, a strut 16 is configured as a generally tubular propellant feed 13 and is conducted directly through the outer wall of the mixer-diffuser housing 20. The plurality of struts 15 are preferably arranged at opposite ends of and distributed circumferentially about the second drive nozzle 12.

A displacement body 14 is disposed on the end of the second drive nozzle 12 facing the first drive nozzle 11. In a preferred embodiment, the displacement body 14 is generally conical and is configured as a supersonic cone or wedge 18 (FIG. 3) having a central axis therethrough. The supersonic cone or wedge 18 has a width B which is substantially equal to the minimum inner diameter of the first mixer part 23. The supersonic cone or wedge 18 defines surfaces inclined relative to central axis at an angle $\alpha$ which is preferably less than 5°. The overall length of the displacement body 14 is indicated in FIG. 1 as l. In a preferred embodiment, l is between approximately 0.4 and 0.5 times the length L of the first mixer part 23.

The first and second drive nozzles 11, 12 define a first jet core 31 and a second jet core 33, respectively, extending from the respective nozzle exits as indicated in FIG. 1 by the generally converging dashed lines. First and second mixing zones 32, 34 are likewise defined for each drive nozzle 11, 12 within, respectively, the first mixer part 23 and second mixer part 24. The mixing zones 32. 34 are indicated by the generally diverging dashed lines emanating from the nozzle exits of the first and second drive nozzles 11, 12.

The distance from the exit of the second drive nozzle 12 to the exit of the second mixer part 24, i.e. to the input of the impulse diffuser 25, is designated by the letter A. In a preferred embodiment, the second cylindrical part 22 extends beyond the exit of the second drive nozzle 12 by a distance of between approximately 0.4 to 0.6 times the distance A.

Referring next to FIG. 2, the second drive nozzle 12 is shown in greater detail. Struts 15 disposed along the upper surface of the second drive nozzle 12 are arranged with respect to the upper surface at a strut angle, $\beta$, which is preferably less than 70°. Struts 15, 16 disposed along the lower surface of the second drive nozzle 12 are arranged at a right angle to the lower surface. In a preferred embodiment, strut 16 is configured as a generally tubular propellant feed 13 to the second drive nozzle 12 and is conducted through the outer wall of the mixer-diffuser housing 20.

As shown more clearly in FIG. 2*a*, the cross-sectional profile of the struts 15 provides minimal impedance to fluid flow through the second cylinder part 22. It will be obvious to one skilled in the art that various cross-sectional profiles will yield the desired low impedance. In a preferred embodiment, a rhombus-like cross-section provides optimal performance, i.e. minimal fluid impedance, for the struts 15 where the angle between the strut 15 surfaces inclined toward the fluid flow is smaller than the angle between the strut 15 surfaces inclined away from the fluid flow.

The disposition of the struts 15, 16 about the second drive nozzle 12 and within the second cylinder part 22 is shown more clearly in FIG. 2*b*.

Figure 3:
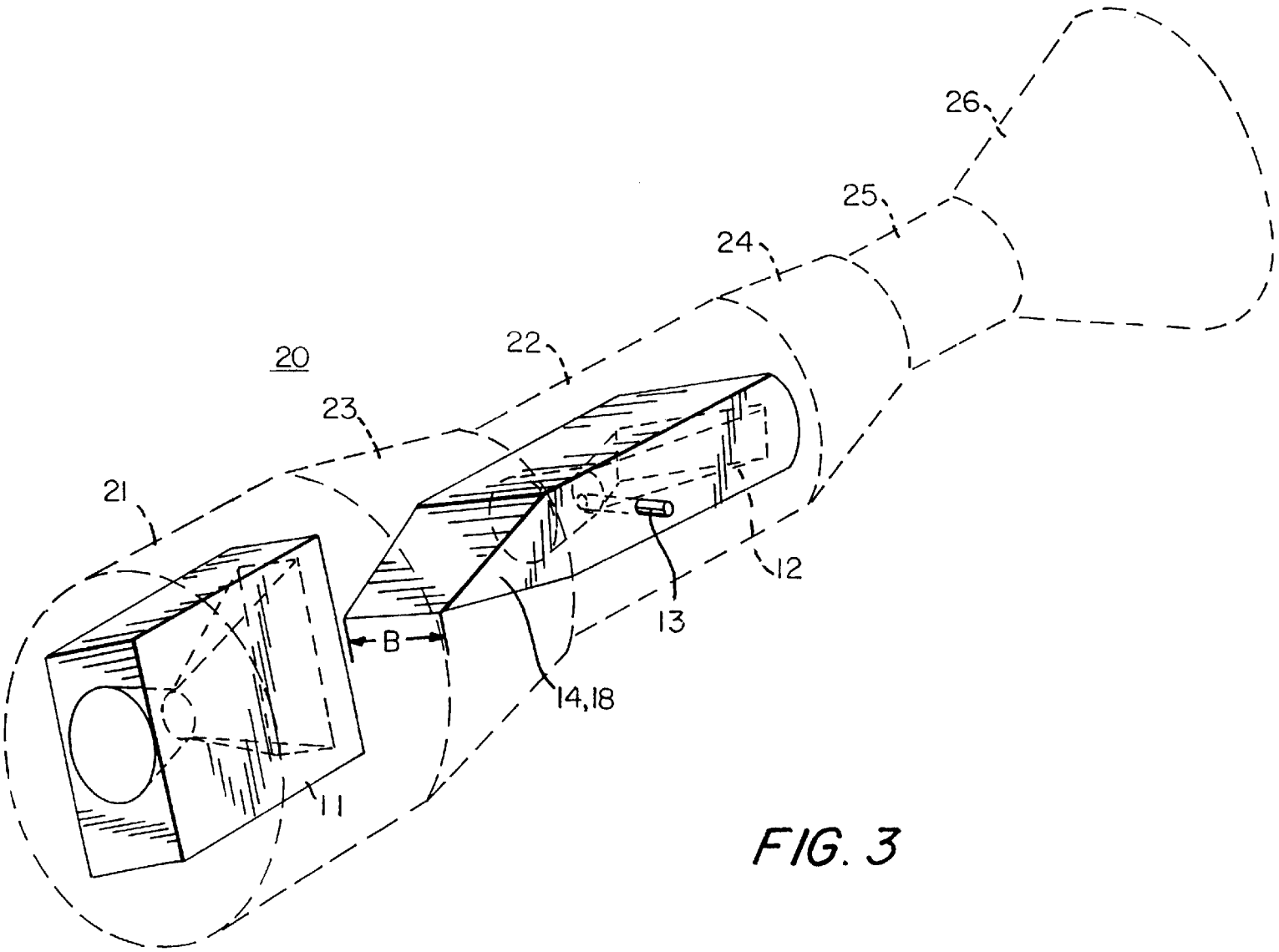
FIG. 3 is a perspective view of the supersonic jet nozzle of FIG. 1.

The perspective view of the supersonic jet nozzle of the present invention shown in FIG. 3 more clearly illustrates the arrangement of the drive nozzles 11, 12 within the respective cylinder parts 21, 22 and the overall configuration of the mixer-diffuser housing 20. The first drive nozzle 11 is substantially rectangular in cross-section oriented with its long sides substantially vertical, including the exit opening. The second drive nozzle 12 is disposed downstream from and in tandem with the first drive nozzle 11 and is also substantially rectangular in cross-section oriented with its long sides substantially horizontal or perpendicular to the long sides of the first drive nozzle 11, including the exit opening. In a preferred embodiment, the cross-section of the second drive nozzle 12 is smaller than the cross-section of the first drive nozzle 11 by a factor of at least 0.8. The generally conical displacement body 14 configured as a supersonic cone or wedge 18 is disposed at the end of the second drive nozzle 12 facing the first drive nozzle 11 and has a width B, which is arranged substantially perpendicular to the exit opening of the first drive nozzle 11.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

I claim:

1. A supersonic device through which a fluid flows comprising:

an elongated tubular housing (20) including a plurality of cylindrical parts;

a first drive nozzle (11) having an exit opening through which a first propellant is directed and being disposed within a first one (21) of said plurality of cylindrical parts of said housing (20);

a second drive nozzle (12) having a leading end and an exit opening through which a second propellant is directed and being disposed within a second one (22) of said plurality of cylindrical parts of said housing (20) axially and in tandem with said first drive nozzle (11), said second drive nozzle (12) including a displacement body (14) positioned on the leading end of the second drive nozzle; and a conical first mixer part (23) defining a first mixing zone (32) therein, said first mixer part (23) disposed adjacent said first one (21) of said plurality of cylindrical parts; and wherein said displacement body (14) extends partially into said conical first mixer part (23) and shape of said displacement body reduces losses in compression pulses which occur in said conical first mixer part in response to the first propellant.

2. The supersonic device as defined in claim 1, wherein said first mixer part (23) has a length (L) and wherein said displacement body (14) has a length (l), said displacement body (14) length (l) being between approximately 0.4 and 0.5 times said first mixer part (23) length (L).

3. The supersonic device as defined in claim 2, wherein said displacement body (14) is configured as a cone (18) having a central axis therethrough and having a surface inclined with respect to said central axis at an angle of less than 5°.

4. The supersonic device as defined in claim 3, further comprising a plurality of struts (15) disposed circumferentially about said second drive nozzle (12) and configured to secure said second drive nozzle (12) to said second one (22) of said plurality of cylindrical chambers, one of said plurality of struts (15) being configured as a propellant feed strut (16).

5. The supersonic device as defined in claim 5, wherein said plurality of struts (15), (16) are configured to minimally impede the flow of fluid through said second one (22) of said cylindrical parts.

6. The supersonic device as defined in claim 6, wherein said plurality of struts (15), (16) are substantially rhombus-shaped in cross-section.

7. The supersonic device as defined in claim 6, wherein said plurality of struts (15), (16) further comprise:

a plurality of first inclined surfaces disposed at a first angle with respect to each other, said first inclined surfaces facing toward the flow of fluid; and a plurality of second inclined surfaces disposed at a second angle with respect to each other, said second inclined surfaces facing away from the flow of fluid;

wherein said first angle is smaller than said second angle.

8. The supersonic device as defined in claim 5, wherein said plurality of struts (15), (16) are disposed at an angle with respect said second drive nozzle (12), said angle being less than 70°.

9. The supersonic device as defined in claim 2, wherein said displacement body (14) is configured as a wedge (18) having a central axis therethrough and having a surface inclined with respect to said central axis at an angle of less than 5°.

10. The supersonic device as defined in claim 9, wherein said wedged (18) defines a width (B) and wherein said first mixer part (23) defines a minimal inner diameter, said width (B) being approximately equal to said minimal inner diameter.

11. The supersonic device as defined in claim 10, further comprising a propellant feed (13) connected directly to said second drive nozzle (12).

12. The supersonic device as defined in 9, wherein said exit opening of said first drive nozzle (11) is substantially rectangular and has a long side and wherein said wedge (18) defines an edge, said edge being substantially perpendicular to said long side of said exit opening.

13. The supersonic device as defined in claim 1, further comprising:

a second mixer part (24) disposed adjacent said second one (22) of said plurality of cylindrical parts; and an impulse diffuser (25) disposed adjacent said second mixer part (24);

wherein a distance (A) is defined between said exit opening of said second drive nozzle (12) and said adjacent edges of said second mixer part (24) and said impulse diffuser (25);

wherein said second one (22) of said plurality of cylindrical parts extends beyond said exit opening in the direction of fluid flow between approximately 0.4 and 0.6 times the distance (A).

14. The supersonic device as defined in claim 1, wherein said first drive nozzle (11) defines a first cross-section and wherein said second drive nozzle (12) defines a second cross-section, said second cross-section being smaller than said first cross-section by a factor of at least 0.8.

* * * * *